US009050847B2

(12) United States Patent
Bramon

(10) Patent No.: US 9,050,847 B2
(45) Date of Patent: Jun. 9, 2015

(54) BOOK BINDING SLEEVE ACCESSORY

(75) Inventor: Lonnie E. Bramon, Garden Valley, ID (US)

(73) Assignee: MARLON, INC., Boise, ID (US)

( * ) Notice: Subject to any disclaimer, the term of this patent is extended or adjusted under 35 U.S.C. 154(b) by 0 days.

(21) Appl. No.: 13/606,721

(22) Filed: Sep. 7, 2012

(65) Prior Publication Data

US 2013/0089391 A1 Apr. 11, 2013

Related U.S. Application Data

(60) Provisional application No. 61/531,661, filed on Sep. 7, 2011.

(51) Int. Cl.

| | |
|---|---|
| ***B42C 99/00*** | (2006.01) |
| ***B42B 5/12*** | (2006.01) |
| ***B42F 1/06*** | (2006.01) |
| ***B42F 1/10*** | (2006.01) |
| ***B42F 3/00*** | (2006.01) |

(52) U.S. Cl.

CPC . *B42C 99/00* (2013.01); *B42B 5/12* (2013.01); *B42B 5/123* (2013.01); *B42F 1/06* (2013.01); *B42F 1/10* (2013.01); *B42F 3/003* (2013.01)

(58) Field of Classification Search

CPC ..... B42B 5/15; B42B 5/123

USPC ..... 412/38–40, 42; 140/92.3, 92.93, 92.94

See application file for complete search history.

(56) References Cited

U.S. PATENT DOCUMENTS

| | | | | |
|---|---|---|---|---|
| 2,112,991 | A | 4/1938 | Madden | |
| 3,348,275 | A * | 10/1967 | Lawrence | 24/DIG. 29 |
| 3,845,521 | A * | 11/1974 | McNichol | 24/67.9 |
| 5,090,097 | A * | 2/1992 | Koester et al. | 24/67.9 |
| 6,036,423 | A | 3/2000 | Westra | |
| 6,640,837 | B2 | 11/2003 | Mori | |
| 6,746,171 | B2 * | 6/2004 | Welch | 402/38 |
| 7,246,982 | B2 | 7/2007 | Desjarlais | |
| 7,407,356 | B2 | 8/2008 | Spiel | |
| 2004/0197163 | A1 * | 10/2004 | Spiel | 412/40 |

* cited by examiner

*Primary Examiner* — Kyle Grabowski

(74) *Attorney, Agent, or Firm* — Charles R. Clark

(57) ABSTRACT

A book binding sleeve accessory receives, aligns, grips, and holds an unbound stack of pages before and during a book binding process. The accessory has an arc-shaped inner bottom wall bridging and connecting between two generally opposing and similarly sized rectangular planar side walls that respectively depend away from said bottom wall and incline towards one another and terminate in two respective and proximate top free edges establishing an at rest position and said side walls can be flexed to a flexed apart position to receive interposed between said side walls an unbound stack to be bound. Preferably the side walls are offset to assist in shaping an unbound stack to align binding holes to match the pitch of a spiral coil used to bind the stack.

4 Claims, 8 Drawing Sheets

BOOK BINDING SLEEVE ACCESSORY

CROSS-REFERENCE TO RELATED APPLICATIONS

Not applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In modern society, efforts are ongoing to develop novel tools to assist a worker to more efficiently and conveniently perform various tasks.

Various book binding systems, binding equipment, and binding accessories of various degrees of complexity have been developed as tools to help a book binding worker bind a stack of aligned pages together in a selected and organized matter into a bound book.

Manually and securely holding a stack of aligned pages together for manual binding of the pages together can be difficult for a book binding worker or other worker to achieve. Often pages shift out of alignment and at times are damaged during the binding process by objects that may contact outside covers or pages of the stack. Manually holding a stack of aligned pages together for inserting for retention a spiral coil into a series of respective and cooperating edge holes along one edge of the stack to secure the stack together in a spiral bound book can also be difficult for a worker to achieve.

BRIEF SUMMARY OF THE INVENTION

The present invention is a book binding sleeve accessory preferably having an arc-shaped inner bottom wall connecting two rectangular planar side walls constructed from a semi-rigid stock sheet material that may include polycarbonate sheets, PETE sheets, PETG sheets, PVC sheets, other suitable plastic sheets, metal sheets, or other suitable sheet material. The book binding sleeve accessory can be made in assorted sizes to accommodate different book sizes and book thicknesses to be bound.

In a best embodiment, a book binding sleeve accessory comprises a semi-circular-arc-shaped inner bottom wall bridging and connecting between two opposing rectangular planar side walls that each depend away from said inner bottom wall to a respective top free edge and said side walls incline towards one another and touch at said top free edges in an at rest position, and said side walls shifted from overlapping each other a selected distance longitudinally along a spine of said inner bottom wall.

In the best embodiment, the sleeve accessory is fabricated from a single sheet of transparent, semi-rigid polycarbonate sheet material that may be flexed under an applied lateral force, but will return to an unflexed state when said force is relieved. Preferably, the sleeve accessory has two positions (conditions): an at rest position having said top edges of said sidewalls in contact or in close proximity with one another and a flexed apart position having said top edges laterally separated and said side walls flexed apart (laterally spread) to be generally parallel to one another by an applied lateral force. When said applied lateral force subsides, the sleeve accessory seeks to return to said at rest position. The transparency of the best embodiment of the accessory enables a worker to observe the contents of the sleeve accessory during use.

A principal objective of this invention is to provide an alignment and holding tool to help a person who wants to insert a spiral coil in a plurality of pages to be bound together into a spiral bound book by providing a book binding sleeve accessory that will assist in aligning pages for binding, protecting pages, gripping pages interposed between the flexed apart side walls, and maintaining the alignment of gripped pages during the insertion of a spiral coil into aligned and communicating edge binding holes along one side of a stack of aligned pages.

The accessory may also be useful to a worker in performing binding processes that use other binding devices than spiral coils and that need a radiused binding edge of a stack or a helix aligned shape of a stack to be bound prior to binding with the other binding device.

An object of the present invention is to provide an easily manufactured book binding sleeve accessory, a novel open-ended, semi-rigid trough having an arc-shaped inner bottom wall bridging between two opposing rectangular planar side walls for selectively receiving, protecting, indexing (aligning), and then gripping in between said planar side walls a stack of a plurality of pages of materials (paper or other planar materials) before and during the insertion of a spiral coil in a plurality of serial binding holes along one edge of each of said pages respectively aligned one page to another page. The spiral coil preferably is made of a PVC plastic material, metal wire, or other suitable material known in the art.

A further object of the invention is making available to users a book binding sleeve accessory that is durable, light weight, easy to use, easy to secure in position, and after use convenient to store for future reuse in other book binding operations.

Use of the sleeve accessory provides protection for the front and back pages of a stack of pages received and gripped within the sleeve during the binding process.

Additional and various other objects and advantages attained by the invention will become more apparent as the specification is read and the accompanying figures are reviewed.

DETAILED DESCRIPTION OF THE INVENTION

The invention is a book binding sleeve accessory 10, 210, 310, 410, 510 comprising an inner bottom wall 12, 212, 312, 412, 512 bridging and connecting between two opposing rectangular planar side walls 14 and 16, 214 and 216, 314 and 316, 414 and 416, each side wall having three free edges including a top free edge opposite said inner bottom wall and two bracketing side free edges, said side walls depend away from said inner bottom wall and preferably incline towards one another and said top free edges generally contact one another. A book binding sleeve accessory may include a plurality of comb-like fingers 550 distributed along a free edge of each said sidewall opposite said inner bottom wall.

Figure 1:
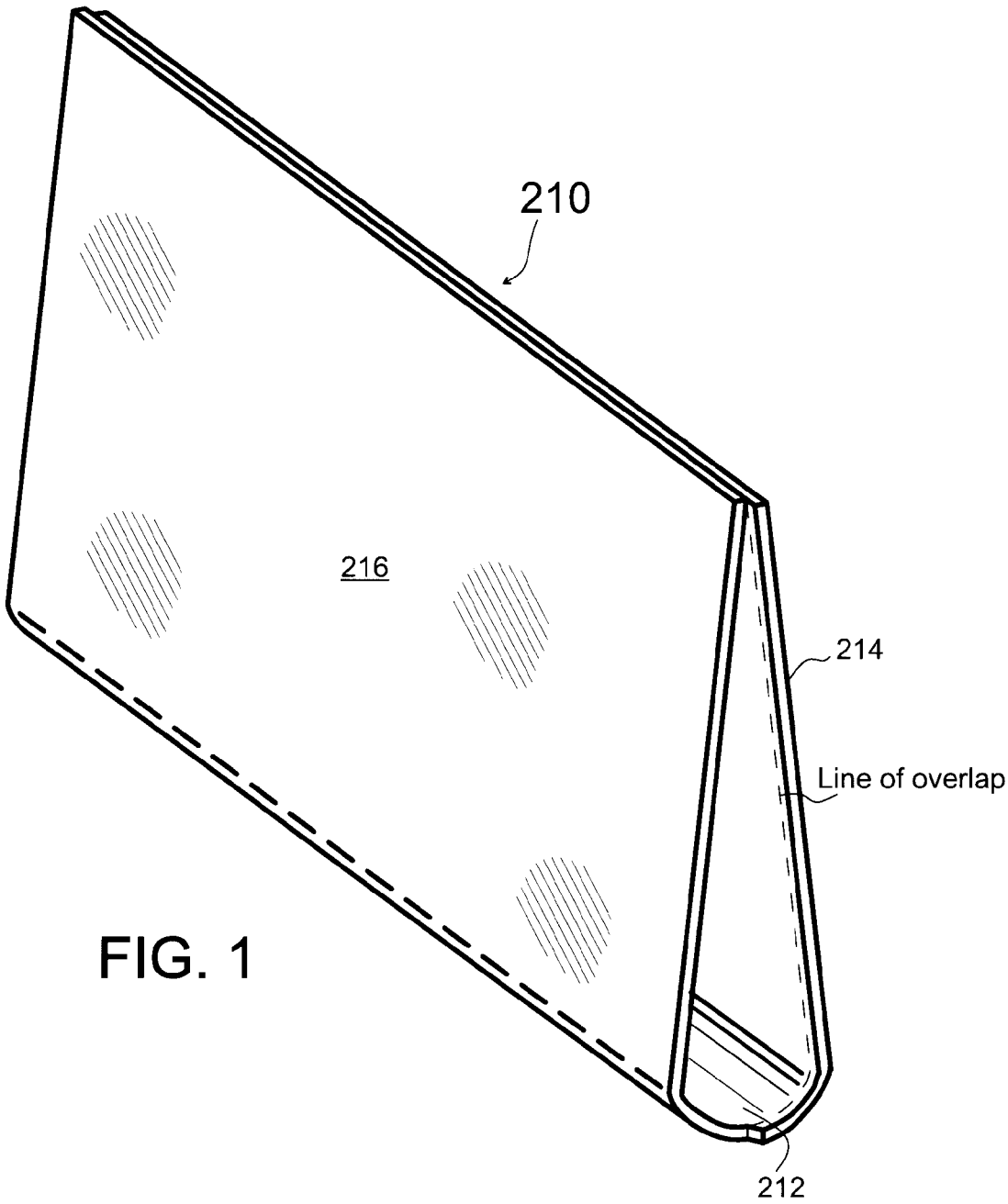
FIG. 1 is a perspective view of a best embodiment of a book binding sleeve accessory 210 having a transversely semi-circular-arc-shaped inner bottom wall 212 bridging between two generally overlapping and opposing similarly-sized rectangular planar side walls 214 and 216 shown in an at rest position.
Figure 2:
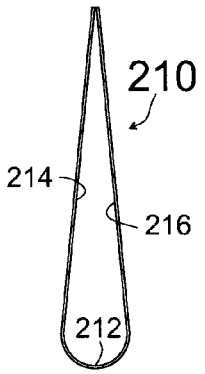
FIG. 2 is a preferred end profile of the book binding sleeve accessory 210 shown in FIG. 1 showing the rectangular planar side walls inclined toward one another and touching together at their upper edges away from the inner bottom wall 212.
Figure 3:
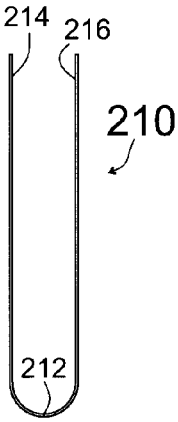
FIG. 3 is an end profile of the best embodiment of the book binding sleeve accessory 210 shown in FIGS. 1 and 2 and showing the two rectangular planar side walls 214 and 216 flexed apart to a flexed apart position.
Figure 4:
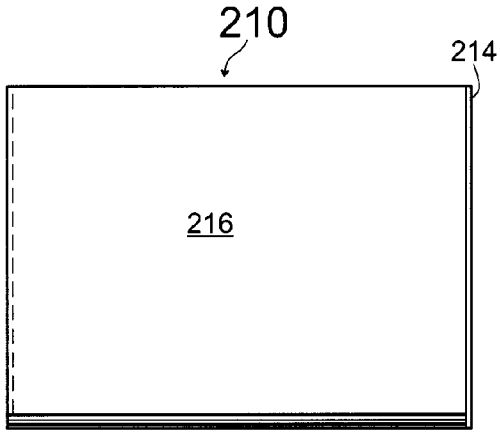
FIG. 4 is a side plan view of the best embodiment of the book binding sleeve accessory 210 shown in FIGS. 1 to 3 in an at rest position.
Figure 5:
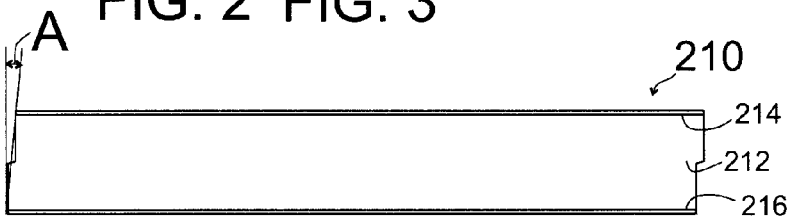
FIG. 5 is a top view of the best embodiment of the book binding sleeve accessory 210 shown in FIGS. 1 to 4 in a flexed apart position looking straight down at the inner bottom wall 212 between two flexed apart and opposing similarly-sized rectangular planar side walls 214 and 216 with said side wall 214 longitudinally offset right and said side wall 214 longitudinally offset left from fully overlapping each other left to right at an angle A (an angle chosen from a range of zero to twenty degrees) right from perpendicular to a plane of one of said planar side walls and said angle A rotating in a plane that includes points coincident with the top free edges of said side walls.
Figure 6:
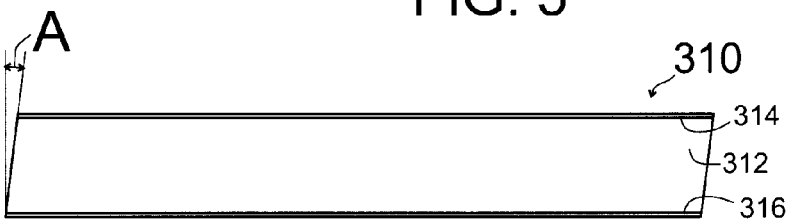
FIG. 6 is a top view of a second embodiment of the book binding sleeve accessory 310 having an arc-shaped inner bottom wall 312 in a flexed apart condition looking straight at the inner bottom wall between two flexed apart and opposing similarly-sized rectangular planar side walls 314 and 316 with said side walls offset from overlapping each other left to right at an angle A (an angle chosen from a range of zero to twenty degrees) right from perpendicular to a plane of one of said planar side walls and said angle A rotating in a plane that includes points coincident with the top free edges of said side walls.
Figure 7:
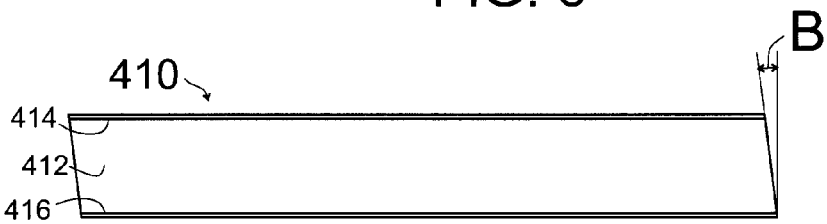
FIG. 7 is a top view of a third embodiment of the book binding sleeve accessory 410 having an arc-shaped inner bottom wall 412 in a flexed apart condition looking straight at the inner bottom wall between two flexed apart and opposing similarly-sized rectangular planar side walls 414 and 416 with said side walls offset from overlapping each other right to left at an angle B (an angle chosen from a range of zero to twenty degrees) left from perpendicular to a plane of one of said planar side walls and said angle B rotating in a plane that includes points coincident with the top free edges of said side walls.
Figure 8:
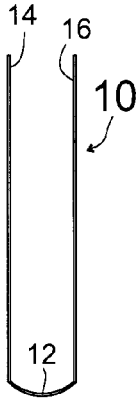
FIG. 8 is an end profile of a basic alternative book binding sleeve accessory 10 having a transversely arc-shaped inner bottom wall 12 bridging between two opposing similarly-sized rectangular planar side walls 14 and 16 shown in a flexed apart position.
Figure 9:
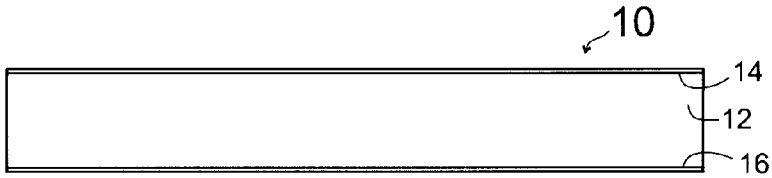
FIG. 9 is a top view of the basic alternative embodiment of the book binding sleeve accessory 10 shown in FIG. 8 looking straight at the inner bottom wall 12 between two opposing similarly-sized rectangular planar side walls 14 and 16 shown in a flexed apart position.
Figure 10:
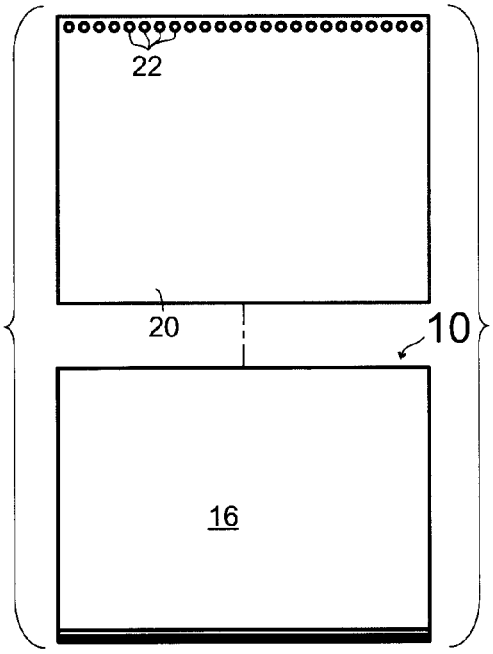
FIG. 10 is a partially exploded side view of the basic embodiment of the book binding sleeve accessory 10 having an arc-shaped inner bottom wall 12 and showing a rectangular planar sidewall 16 and showing an unbound stack of pages 20 having a plurality of binding holes 22 distributed along a stack top edge awaiting insertion into the sleeve accessory.
Figure 11:
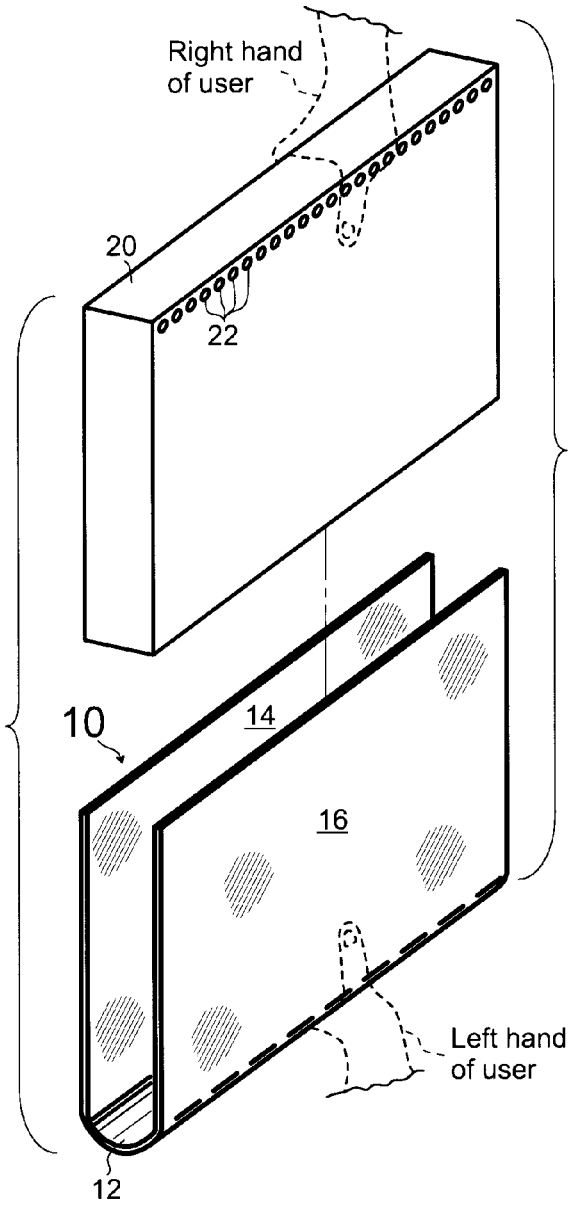
FIG. 11 is a partially exploded perspective view of the basic embodiment of the book binding sleeve accessory 10 and showing an unbound stack of pages 20 having a plurality of binding holes 22 distributed along a stack top edge awaiting insertion into the sleeve accessory.
Figure 12:
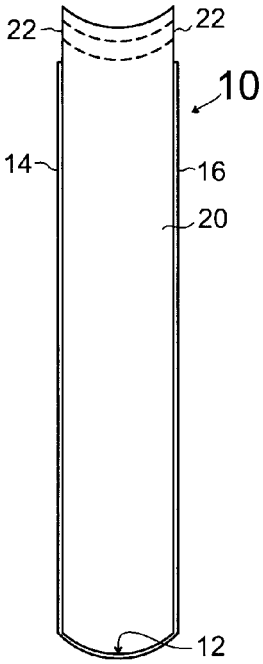
FIG. 12 is an end view of the basic embodiment of the book binding sleeve accessory 10 shown in FIG. 11 showing an aligned unbound stack 20 of pages aligned along a stack bottom edge with the inner bottom wall after insertion of the stack into the sleeve accessory.

FIG. 1 shows a book binding sleeve accessory 210 having a semi-circular-arc-shaped inner bottom wall 212 bridging and connecting between two generally opposing similarly-sized rectangular planar side walls 214 and 216.

FIGS. 12 to 17 and 19 to 21 show a stack 20 or 20' having a plurality of similarly sized pages, papers, or other sheet materials with similar binding holes to be spirally bound by a spiral coil received within an open-ended, book binding sleeve accessory 10, 210, 310, 410, 510 and aligned one to another along their bottom edges to the inner bottom wall 12, 312, 412, 512 of the sleeve accessory and aligned one page to another page along at least one of their respective side edges along a plane defined by a respective set of left free edges or right free edges of two side walls of the sleeve accessory. The pages, papers or other sheet materials have a plurality of binding holes 22 along their top edges opposite and away from the inner bottom wall.

Referring to FIGS. 1 through 21, a user such as a book binding worker, an office worker or some other worker (user) can use a selected book binding sleeve accessory sized to receive a stack of unbound pages having similar sizes and having similar binding holes distributed along one edge, to align the pages left to right with a set of right free edges or left free edges of the two side walls of the sleeve accessory, to align the pages along the stack bottom edge adjacent to the inner bottom wall into a convex arc shaped edge profile resulting in a stack top edge having a concave arc shaped edge profile with the binding holes aligned along an arc for insertion of a spiral coil, and to grip the stack during the insertion of the spiral coil or other binding device into the binding holes.

Each book binding sleeve accessory 10, 210, 310, 410, 510 can be made from a semi-rigid polycarbonate sheet material that can flex apart from an at rest position to a flexed apart position or made from another suitable semi-rigid sheet material that can flex apart from an at rest position to a flexed apart position such as a sheet made of PETE , PETG, polyethylene, metal, or other suitable material.

Figure 13:
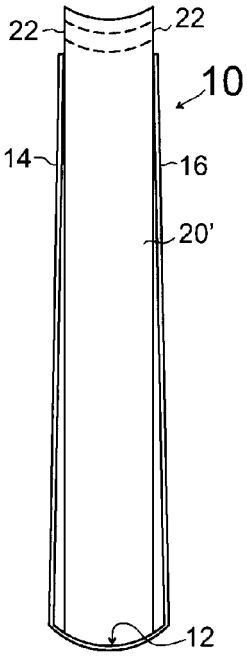
FIG. 13 is an end view of the basic embodiment of the book binding sleeve accessory 10 shown in FIG. 11 showing an aligned unbound stack 20' of pages (stack 20' thinner than stack 20 shown in FIG. 12) aligned along a stack bottom edge with the inner bottom wall 12 after insertion of the stack into the sleeve accessory and the side walls pressuring the stack together and gripping the stack while the side walls seek the at rest position of the sleeve accessory.
Figure 14:
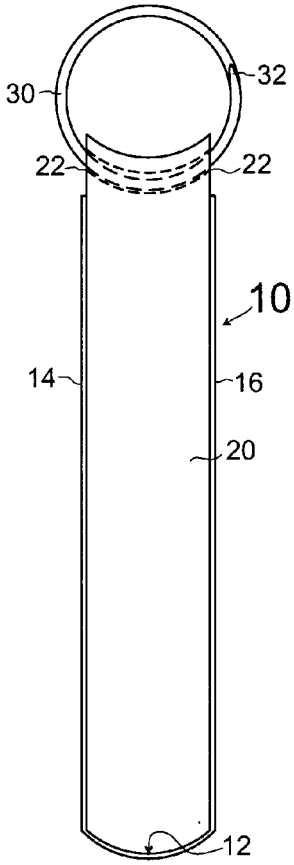
FIG. 14 is an end view of the basic embodiment of the book binding sleeve accessory 10 shown in FIG. 12 showing an aligned unbound stack 20 of pages aligned along a stack bottom edge against the inner bottom wall after insertion of the stack into the sleeve and showing a spiral coil 30 having a leading free end 32 rotatably inserted into and retained within said binding holes.
Figure 15:
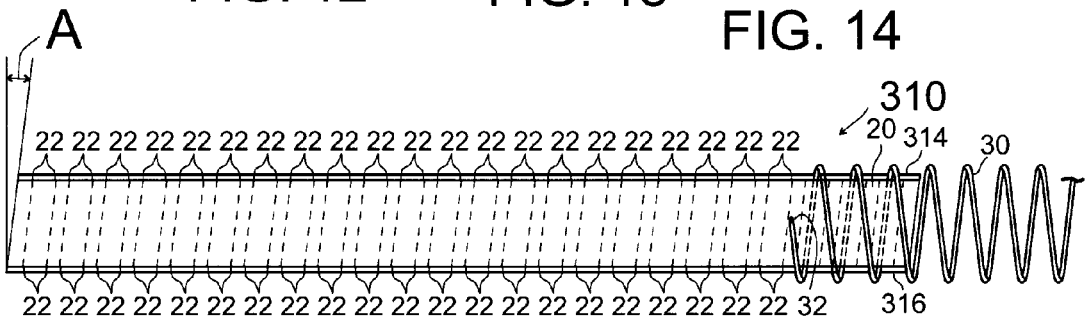
FIG. 15 is a top view of the second embodiment of the book binding sleeve accessory 310 shown in FIG. 6 looking straight down at a top side of a stack 20 of pages inserted into the sleeve accessory, the stack having a plurality of binding holes 22 distributed along a stack top edge and respectively aligned one hole in one page to a closely adjacent communicating hole in a next page at an angle A from perpendicular to a face of the stack and said angle A rotating in a plane that includes points coincident with the stack top edge, and the stack gripped between two opposing similarly-sized rectangular planar side walls 314 and 316 with said planar side walls offset from each other left to right by the angle A (an angle chosen from a range of zero to twenty degrees) right from perpendicular to a plane of one of said planar side walls and said angle A rotating in a plane that includes points coincident with the top free edges of said side walls and showing a spiral coil 30 having a leading free end 32 spiraling from right to left and clockwise into and retained within the respective aligned holes.
Figure 16:
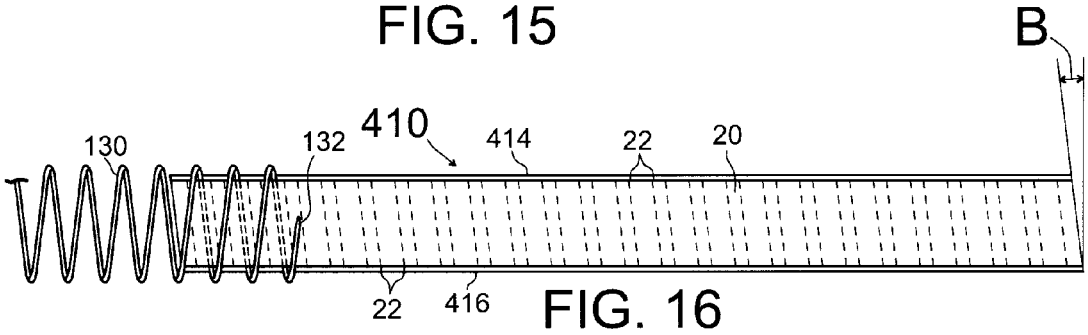
FIG. 16 is a top view of a third embodiment of the book binding sleeve accessory 410 looking straight down at a top side of a stack 20 of pages inserted into the sleeve accessory, the stack having a plurality of binding holes 22 along a stack top edge and respectively aligned one hole in one page to a closely adjacent communicating hole in a next page at an angle B from perpendicular to a face of the stack and said angle B rotating in a plane that includes points coincident with the stack top edge, and the stack gripped between two opposing similarly-sized rectangular planar side walls 414 and 416 with said planar side walls offset from each other right to left by the angle B (an angle chosen from a range of zero to twenty degrees) left from perpendicular to a plane of one of said planar side walls and said angle B rotating in a plane that includes points coincident with the top free edges of said side walls and showing a spiral coil 130 having a leading free end 132 spiraling from left to right and counter-clockwise into and retained within the respective aligned holes.
Figure 17:
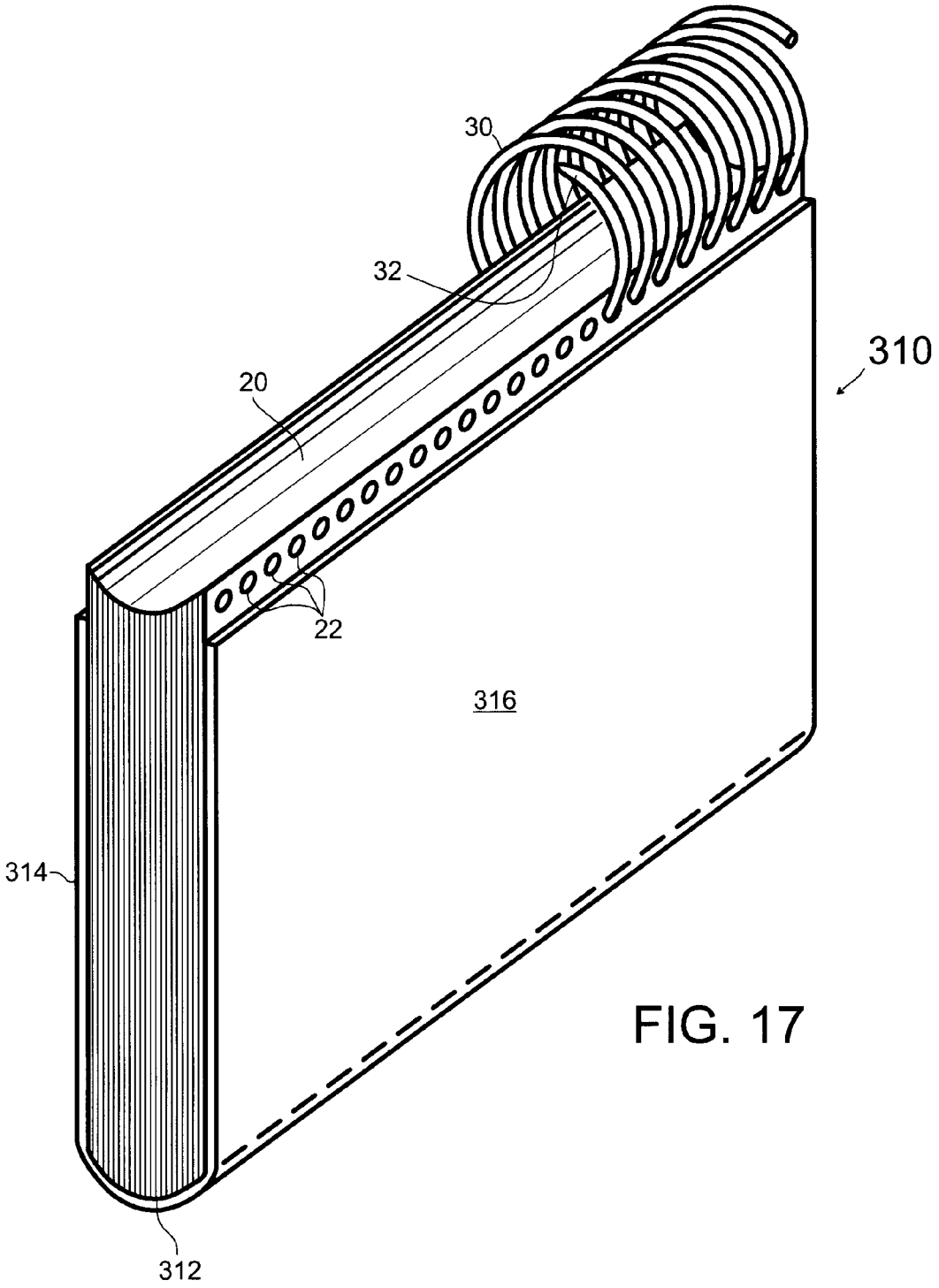
FIG. 17 is a perspective view of the second embodiment of the book binding sleeve accessory 310 and the aligned stack 20 shown in FIG. 15 showing a spiral coil 30 having a leading free end 32 spiraling from right to left and clockwise into and retained within the respective aligned holes 22.
Figure 18:
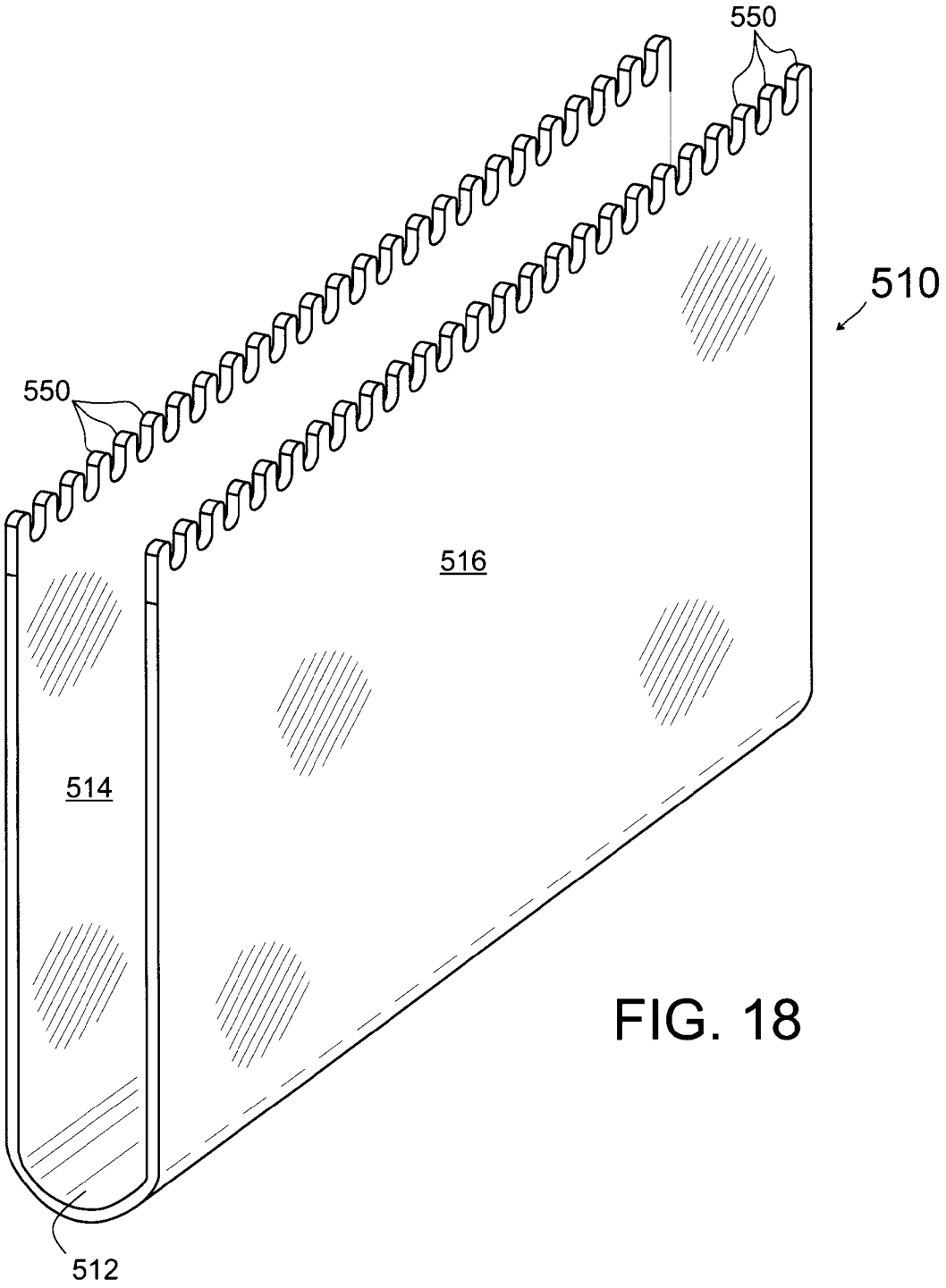
FIG. 18 is a perspective view of a fifth embodiment of the book binding sleeve accessory 510 having an arc-shaped inner bottom wall 512 bridging between two generally opposing similarly-sized rectangular planar side walls 514 and 516 each said planar side wall having a plurality of cooperating comb-like fingers 550 distributed along a top free edge of the planar side wall opposite the inner bottom wall and said fingers sized and spaced to extend between respective outermost adjacent binding holes of an immediately adjacent page of an unbound stack of pages inserted into and aligned within the sleeve accessory to be spirally bound (sleeve accessory shown in a flexed apart position and unbound stack not shown; see FIGS. 19 and 20)
Figure 19:
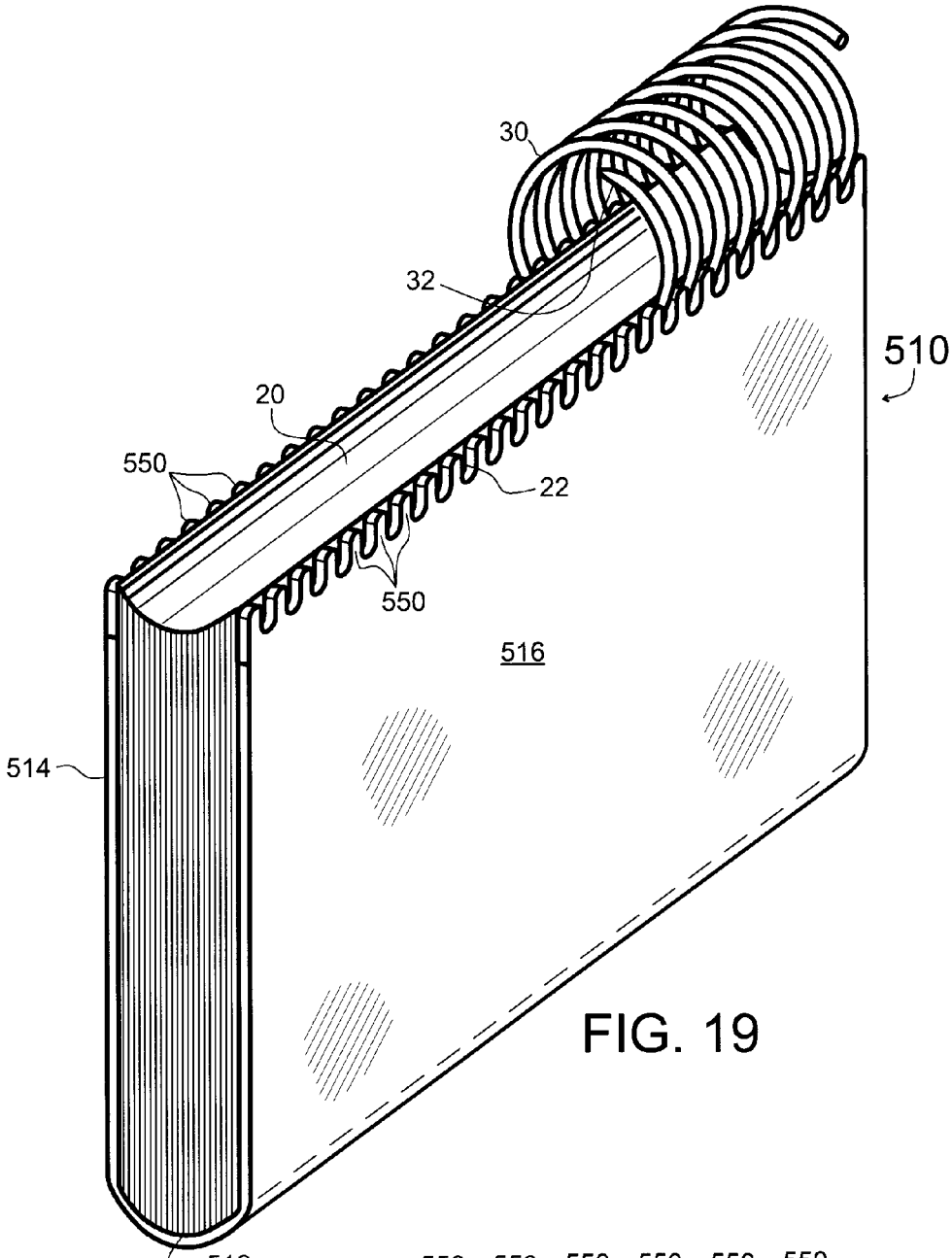
FIG. 19 is a perspective view of the fifth embodiment of the book binding sleeve accessory 510 shown in FIG. 18 and showing a spiral coil 30 having a leading free end 32 spiraling from right to left and clockwise into respective aligned binding holes 22 of a stack 20 of pages aligned and gripped for spiral binding within the sleeve accessory and respective outermost binding holes located between the cooperating comb-like fingers 550.
Figure 20:
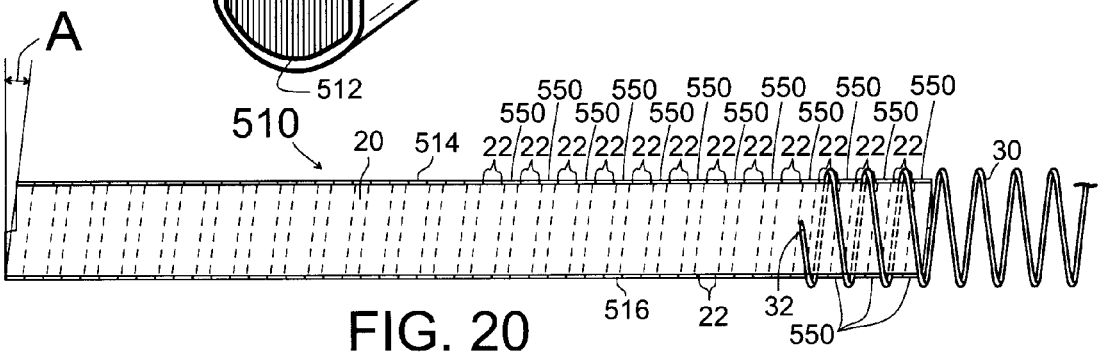
FIG. 20 is a top view of the fifth embodiment of the book binding sleeve accessory 510 shown in FIG. 19 looking straight down at a top side of a stack 20 of pages inserted into the sleeve accessory, the stack having a plurality of binding holes 22 distributed along the stack top edge and respectively aligned one hole in one page to a closely adjacent communicating hole in a next page at an angle A from perpendicular to a face of the stack and said angle A rotating in a plane that includes points coincident with the stack top edge, and the stack gripped between two opposing similarly-sized rectangular planar side walls 514 and 516 with said planar side walls offset from each other left to right by the angle A (an angle chosen from a range of zero to twenty degrees) right from perpendicular to a plane of one of said planar side walls and said angle A rotating in a plane that includes points coincident with the top free edges of said side walls and showing a spiral coil 30 having a leading free end 32 spiraling from right to left and clockwise into and retained within the respective aligned binding holes.
Figure 21:
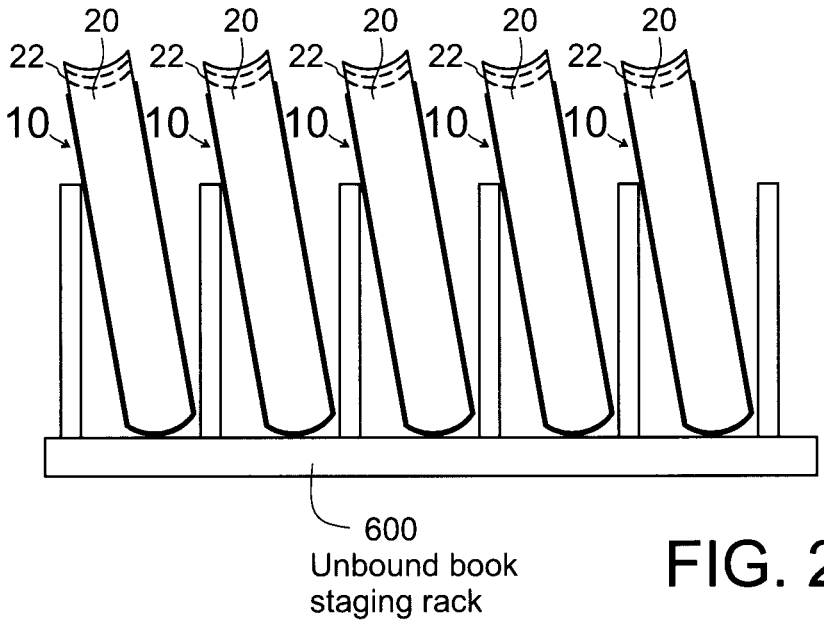
FIG. 21 is a front plan view of an unbound book staging rack 600 showing a plurality of unbound stacks 20 staged within respective binding sleeve accessories 10 and awaiting insertion of respective spiral coils (coils not shown).

As shown in FIG. 21, a plurality of sleeve accessories can be used by a book binding worker to prepare and stage a plurality of unbound books for subsequent insertion of a respective plurality of spiral coils. A sleeve accessory can be provided to a book binding worker to receive, align, and grip an unbound book 20 of a specific thickness see FIG. 12 to be later bound and that sleeve may also be used with an unbound book 20' of less thickness as shown in FIG. 13.

Preferably, a series of color-coded sleeve accessories are made available to a book binding worker for use with a graduated range of different thicknesses of unbound books. For example, a color-coded series may provide: a red sleeve having a semi-circular-arc shaped inner bottom wall diameter of two inches for use with unbound books ranging from one to two inches in thickness; a blue sleeve having a semi-circular-arc shaped inner bottom wall diameter of one and three quarters inches for use with unbound books ranging from one to one and three quarters inches in thickness; a yellow sleeve having a semi-circular-arc shaped inner bottom wall diameter of one and a half inches for use with unbound books ranging from one to one and a half inches in thickness; a green sleeve having a semi-circular-arc shaped inner bottom wall diameter of one and a quarter inches for use with unbound books ranging from three quarters to one and a quarter inches in thickness; a black sleeve having a semi-circular-arc shaped inner bottom wall diameter of one inch for use with unbound books ranging from one half to one inch in thickness; and smaller clear sleeves having semi-circular-arc shaped inner bottom wall diameters of three quarters, a half, or a quarter inch for use with books ranging from zero to three quarters inch, zero to a half inch, or zero to a quarter inch in thickness.

A book binding sleeve accessory can be fabricated having a specific angle A or angle B selected to match a pitch angle of a spiral coil to be used with an unbound stack of pages to be gripped within the accessory during a spiral coil book binding process.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A book binding sleeve accessory sized and shaped to receive, to align, to grip, and to hold an unbound stack of pages before and during a book binding process comprising a transversely arc-shaped inner bottom wall bridging and connecting between two generally opposing and similarly sized rectangular planar side walls that respectively depend away from said inner bottom wall and terminate in two respective and proximate top free edges in an at rest position;

said planar side walls are semi-rigid and can be flexed apart from one another from said at rest position to a flexed apart position by application of a lateral force with said walls being generally parallel to one another; and said planar side walls having respective left free edges and respective right free edges and said side walls partially overlap one another at an angle across both left free edges or both right free edges, said angle selected from a range of greater than zero to twenty degrees right or left from perpendicular to a plane of one of said planar side walls and said angle rotating in a plane that includes points coincident with said top free edges of said side walls.

2. A book binding sleeve accessory according to claim 1 further comprising a plurality of comb-like fingers distributed along each said top free edge.

3. A book binding sleeve accessory sized and shaped to receive, to align, to grip, and to hold an unbound stack of pages before and during a book binding process comprising a transversely arc-shaped inner bottom wall bridging and connecting between two generally opposing and similarly sized rectangular planar side walls that respectively depend away from said inner bottom wall and terminate in two respective and proximate top free edges in an at rest position having said side walls touch at said top free edges;

said planar side walls are semi-rigid and can be flexed apart from one another from said at rest position to a flexed apart position by application of a lateral force with said walls being generally parallel to one another;

said planar side walls overlap one another a selected distance longitudinally along a line parallel to a longitudinal axis of said inner bottom wall;

said planar side walls having respective left free edges and respective right free edges and said side walls overlap one another at an angle across both left free edges or both right free edges, said angle selected from a range of greater than zero to twenty degrees right or left from perpendicular to a plane of one of said planar side walls and said angle rotating in a plane that includes points coincident with said top free edges of said side walls; and a plurality of comb-like fingers distributed along each said top free edge.

4. A book binding sleeve accessory sized and shaped to receive, to align, to grip, and to hold an unbound stack of pages before and during a book binding process comprising a transversely arc-shaped inner bottom wall bridging and connecting between two generally opposing and similarly sized rectangular planar side walls that respectively depend away from said inner bottom wall and terminate in two respective and proximate top free edges in an at rest position having said side walls touch at said top free edges;

said planar side walls are semi-rigid and can be flexed apart from one another from said at rest position to a flexed apart position by application of a lateral force with said walls being generally parallel to one another;

said planar side walls overlap one another a selected distance longitudinally along a line parallel to a longitudinal axis of said inner bottom wall;

said planar side walls having respective left free edges and respective right free edges and said side walls overlap one another at an angle across both left free edges or both right free edges, said angle selected from a range of greater than zero to twenty degrees right or left from perpendicular to both a plane of one of said planar side walls and to a line parallel to a longitudinal axis of said inner bottom wall; and a plurality of comb-like fingers distributed along each said top free edge.

* * * * *